United States Patent [19]

Fischbach

[11] Patent Number: 4,794,730

[45] Date of Patent: Jan. 3, 1989

[54] HARDWARE FOR CLOSURE

[75] Inventor: Karl H. Fischbach, Freudenberg, Fed. Rep. of Germany

[73] Assignee: Siegenia-Frank KG, Siegen, Fed. Rep. of Germany

[21] Appl. No.: 119,144

[22] Filed: Nov. 10, 1987

[30] Foreign Application Priority Data

Nov. 10, 1986 [DE] Fed. Rep. of Germany ..... 3638356
Dec. 22, 1986 [DE] Fed. Rep. of Germany ..... 3643964

[51] Int. Cl.[4] ..... E05D 15/20

[52] U.S. Cl. ..... 49/130; 49/221; 52/207

[58] Field of Search ..... 49/127, 130, 129, 219, 49/221, 223; 52/207

[56] References Cited

U.S. PATENT DOCUMENTS 4,551,945 11/1985 von Resch ..... 49/130 X

*Primary Examiner*—Philip C. Kannan
*Attorney, Agent, or Firm*—Blodgett & Blodgett

[57] ABSTRACT

Hardware for a door or window, in which the closure can be moved out of the opening in the stationary frame to another position parallel to the said opening and then moved horizontally to a position that is non-coextensive with the opening. Upper and lower swing arms are provided, each connecting the closure to a traveling carriage. A releasable locking device is provided to lock the closure in the outer position, the device having a supporting lever connecting the swing arm to the carriage. This lever is brought into working position during the movement of the closure by means of a control lug with a thrust abutment located on the frame. The supporting lever consists of a bell crank pivotally mounted on the carriage, which crank carries the control lug at the end of one arm directed toward the stationary frame. The other arm, extending toward the swing arm, is pivotally connected to a connecting rod which is also swingably connected to the swing arm. The connecting rod and the bell crank that is connected to it from a toggle that is reversible by use of the control lug and a thrust abutment on the stationary frame. This occurs automatically at its extended position when the closure moves toward its closing position, releasing the swing arm from the position in which it is locked by an over-center condition of the toggle.

11 Claims, 6 Drawing Sheets

HARDWARE FOR CLOSURE

BACKGROUND OF THE INVENTION

This invention relates to hardware for the closure of a window or door, which closure is at least lockable in spaced, parallel position and in this position is horizontally shiftable. The hardware has lower and upper swing arms which are pivotally mounted, on the one hand, on the lower transverse closure bar and, on the other hand, on a traveling carriage. A releasable locking device is provided at least for the lower swing arms when they are located in the parallel-stop position. The locking device consists of a supporting lever operating on the swing arm in the region of the traveling carriage and can be brought into operative engagement with an abutment located on the stationary frame during the slide-to-close motion of the closure.

Hardware of this kind has already been disclosed in U.S. Pat. No. 2,741,807 and also in French Pat. No. 1,551,381. Their advantage resides in the fact that, with a simple design construction, they are robust in use and can, therefore, also be used when heavy closures are to be brought out into a parallel-stop position relative to the stationary frame and then to be shifted horizontally.

The construction principles of these known hardware designs are such that the supporting lever in each case has to interact over the total length of the horizontal shifting path of the closure with a stationary abutment when the parallel-stop position of the swing arms is to be fixed in any possible slide position.

In the hardware as shown in the U.S. Pat. No. 2,741,807, the supporting lever can also be released in an undesirable manner on account of its swivel mounting provided at the closure and because of objects projecting into the path of motion of its control lug, before it has attained its shift-close end position. This deficiency has been avoided on the hardware shown in the French Pat. No. 1,551,381; in that case, the supporting lever is mounted at the traveling carriage and its control lug is constantly in guiding contact till the closure has reached the shift-close end position. Only then the control lug (and thereby the supporting lever for the swing arms) is rendered free, so that the closure can subsequently be moved by means of the swing arms into its closed position in the stationary frame.

In the case of the hardware shown in the German Pat. OS No. 32 34 677, the locking device which determines the parallel stop position of the swing arms can be pressed undesirably out of the locking position by means of objects getting into the path of motion of a lock element located on a control arm.

Unlike the hardware shown in the U.S. Pat. No. 2,741,807, in the case of a similar fitting shown in German GM No. 84 35 367, a supporting lever designed as a bell crank is pivotally mounted on the traveling carriage. The supporting lever is so designed that a control lug provided on one of its lever arms always leads the traveling carriage in the shift-close position, while the lever arm facing the swing arm is more or less oriented at an obtuse angle position relative to the traveling carriage in the shift-close direction of the closure.

In the case of the hardware shown in U.S. Pat. No. 2,741,807 and German Pat. OS No. 32 34 677, the supporting lever fixing the parallel-stop position of the swing arms can be undesirably pressed out from its locking position before arriving at the stationary thrust abutment, because of objects getting into the path of motion of its control lug, since the control lug seen in shift-close position of the closure is constantly exposed ahead of the traveling carriage.

It is, therefore, an object of the present invention to provide hardware of the initially-described kind in which the swing arms are securely fixed in their parallel-stop position by means of a releasable locking device and in which a cam abutment working in cooperation with the control lug of the supporting lever is provided at the stationary frame only in the region of the shift-close motion of the closure.

With these and other objects in view, as will be apparent to those skilled in the art, the invention resides in the combination of part set forth in the specification add covered by the claims appended hereto.

SUMMARY OF THE INVENTION

In general, the present invention consists of hardware for a closure in which the supporting lever is a bell crank pivotally mounted at a traveling carriage. The lever carries a control lug at the end of the arm extending toward the stationary frame in which the closure is mounted. The lever arm which extends toward the swing arm is pivotally connected to a connecting rod which similarly engages the swing arm pivotally. The connecting rod and the arm of the supporting lever engaging it form together a toggle which is reversible by means of the control lug of the supporting lever and a cam on the frame. This is accomplished during the shift-close position of the closure in a locked manner at least out of an extended position which blocks the parallel-stop position of the one of the swing arms between the traveling carriage and the swing arm into a closed position which releases it. The lever arm of the bell crank which carries the control lug is provided in the extended position of the toggle in a trailing manner relative to the shift-close direction of the closure.

The advantage of this development resides in that an inadvertent and undesirable release of the locking device is effectively prevented, until the shift-close end-motion of the closure is reached, by objects which are in the path of motion of the supporting lever. This is because the locking device has swivel joints which lie only in the shift-close end-motion of the closure, which are staggered relative to one another, and which are, therefore, controllable by existing impediments in the blocking direction only.

A particularly effective and functionally reliable development has proved to be a disengaging device in which the bell crank is such that the two lever arms extend at an acute angle to one another, so that the lever arm facing the toggle as trailing relative to the shift-close direction of the closure of the support site of the supporting lever at the traveling carriage.

This development ensures that either the traveling carriage itself (which has the swivel mounting of the supporting lever) removes by its kinetic energy objects which came into the path of motion of the supporting lever or that the toggle which locks the parallel stop position of the swing arm is stressed in the direction of monitoring its extended position.

In this connection it is particularly advantageous, according to the invention, when the extended position of the toggle locking the parallel-stop position of the swing arm corresponds to a slight kink position defined by a limiting stop which is directed opposite to the kink position which releases the parallel stop position of the swing arms.

In accordance with the invention, it is further proposed that the control lug at the supporting lever consists of a guide roller, while the thrust abutment at the frame is formed as a stationary cam located only in the region of the shift-close end-motion of the closure.

It is also proposed that the pivot of the toggle in its kink position (which releases the parallel-stop position of the swing arm) is insertable in a notch at the frame thrust abutment and, therefore, ensures that, at beginning of the opening motion of the closure, the swing arm of the hardware is given a momentum that is directed away from the stationary frame in the direction of the parallel-stop position.

It is equally important that the notch claw is provided at the thrust abutment with a start-up buffer for the traveling carriage. This buffer is spring-biased opposite to the direction of the shift-close end-motion, whereby the traveling carriage can attain with the start-up buffer supporting contact exclusively on an kink position of the toggle which releases the parallel stop position of the swing arm. On impingement of the traveling carriage with the spring-mounted start-up buffer, its kinetic energy is elastically cushioned, while the kinetic energy of the closure acting in the closing direction moves the swing arms from their released parallel-stop position in the direction of the freestanding frame. In that way, the toggle is more and more kinked and finally engages its pivot with the notch claw at the frame thrust abutment.

An advantageous effect of the hardware is finally also achieved, because of the kink position of the toggle, corresponding to the closed position of the closure at the stationary frame, the control lug of the supporting lever is supportingly undercut at the swing arm by the articulated pivot of the connection at the swing arm. Because of the development of the supporting lever as an angled lever, the pivot of the toggle is pressed into effective engagement with the notch claw at the thrust abutment, as long as the closure maintains its closed position at the freestanding frame.

The purpose of the invention is also achieved, because the supporting lever is a bell crank pivotally mounted at the traveling carriage, which lever carries the central lug at the end of the lever arm facing towards the stationary frame. The lever arm facing towards the swing arm is pivotally attached to a connecting rod which likewise pivotally engages the swing arm. The connecting rod and the supporting lever engaging it form a toggle which is automatically reversible by the control lug of the supporting lever and the thrust abutment at the frame during the shift-close end-motion of the closure. It is moved from an extended position locking the parallel-stop position of the swing arm between the traveling carriage and the swing arm into a kink position which releases it. The lever arm of the bell crank carrying the control lug is provided in the extended position of the toggle (relative to the shift-close-direction of the closure) as trailing the support site of the supporting lever at the traveling carriage. The connecting rod is similarly designed as a bell crank and its lever arm which projects beyond the pivot at the swing arm is connected pivotally by a pinion in a guide slot located on the closure. The guide slot is provided at the end assigned to the parallel position of the closure with a notch for the pinion. The particular advantage of this development resides in that a stable supporting connection is ensured for the closure when located in its parallel-stop position.

In the parallel-stop position of the closure, the lever arm of the connecting rod projecting beyond the joint on the swing arm acts as an additional supporting link which operates counter to an angular torsion of the closure mounting site of the swing arm and, therefore, considerably improves the holding function of the hardware. The hardware has proved to be particularly useful and functionally reliable when the notch slants towards the guide slot and where its angle of slope is approximately congruent with a curvature whose center is in alignment with the joint of the connecting rod on the swing arm when located in the parallel-stop position relative to the closure.

With forces acting upon the closure in the direction toward the stationary frame, the engagement of the pinion with the notch is automatically and positively assured. The notch can also be provided with its end facing away from the stationary frame at the closure.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
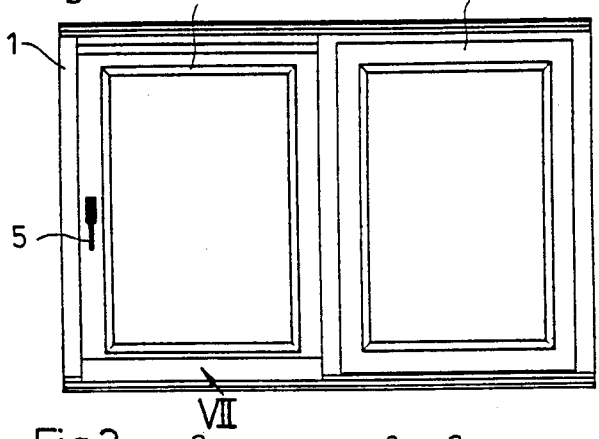
FIGS. 1 and 2 are front and side elevations of a door in the closed position of the closure.

FIGS. 1 to 6 of the drawing show a balcony or terrace door having a fixed frame 1 and a fixedly mounted closure 2 or a solid panel, which door is additionally equipped with a movable closure 3.

Figure 2:
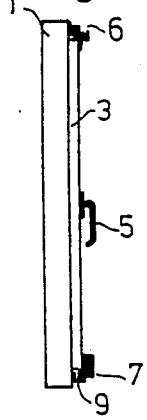
Figure 3:
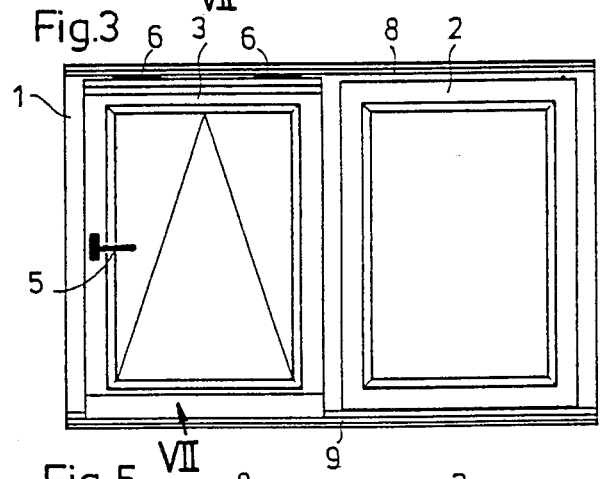
FIGS. 3 and 4 are front and side elevations of the door with the closure open in tipped position.
Figure 4:
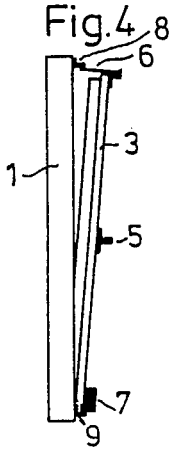
Figure 5:
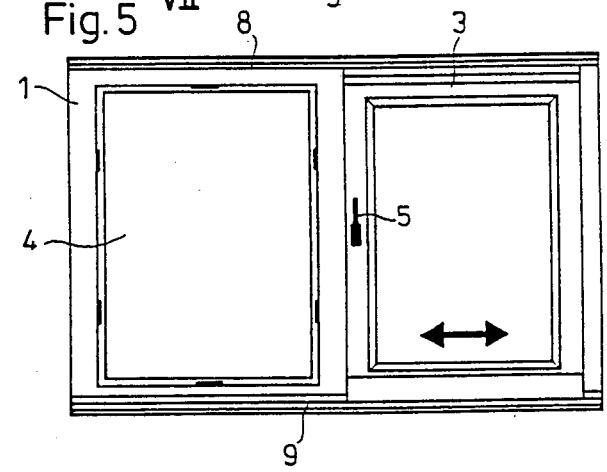
FIGS. 5 and 6 are front and side elevations of the door with the closure horizontally pushed into open position.
Figure 6:
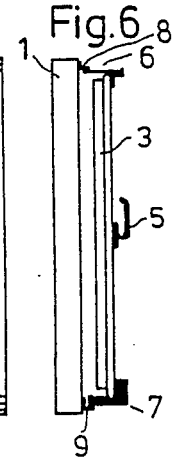

The movable closure 3 can hereby be brought (relative to the stationary frame 1 and to the fixed door panel or closure 2) from the closed position, indicated in FIGS. 1 and 2, into the tilt-open position, shown in FIGS. 3 and 4. It can also be moved out of the fixed frame 1 and the stationarily-mounted closure 2 into a parallel-stop position, after which it can be shifted from the region of the passage opening 4 of the stationary frame 1 in the horizontal direction to a position in front of the fixed closure 2 or the solid door panel, as can be seen in FIGS. 5 and 6.

In order to permit these three positions of the closure 3 relative to the fixed frame 1 and to the fixed closure 2 there is provided between the closure 3 and the stationary frame 1 a special fitting hardware, consisting of a so-called "tilt-parallel-stop slide-fitting". This hardware can be seen in simple form in the FIGS. 1 to 6 along with the operating control 5 at the closure 3, with an upper disengaging hardware 6, and with a lower disengaging hardware 7 extending between the closure 3 and the stationary frame 1.

From the aspect of kinematics, the upper disengaging hardware 6 and the lower disengaging hardware 7 can be of similar construction. The basic design of the upper disengaging hardware 6 can, however, also be derived from such constructions as are used for windows or doors with tilt or rotary tip closures which are part of the prior art, for example, as shown in the DE-GM No. 1,774,702, the DE-GM No. 1,813,918, and the DE-AS No. 10 75 007. It is only necessary that care be taken that the frame-side articulation sites of such hardware constantly engage in a horizontal slide-guide 8 at the upper transverse bar of the stationary frame 1 and that a synchronous movement of their swing arms be ensured.

The lower disengaging hardware 7 must in any case be so designed that it is capable of carrying the weight of the movable closure 3, while it interacts with a guide rail 9 at the lower transverse bar of the stationary frame 1.

Figure 7:
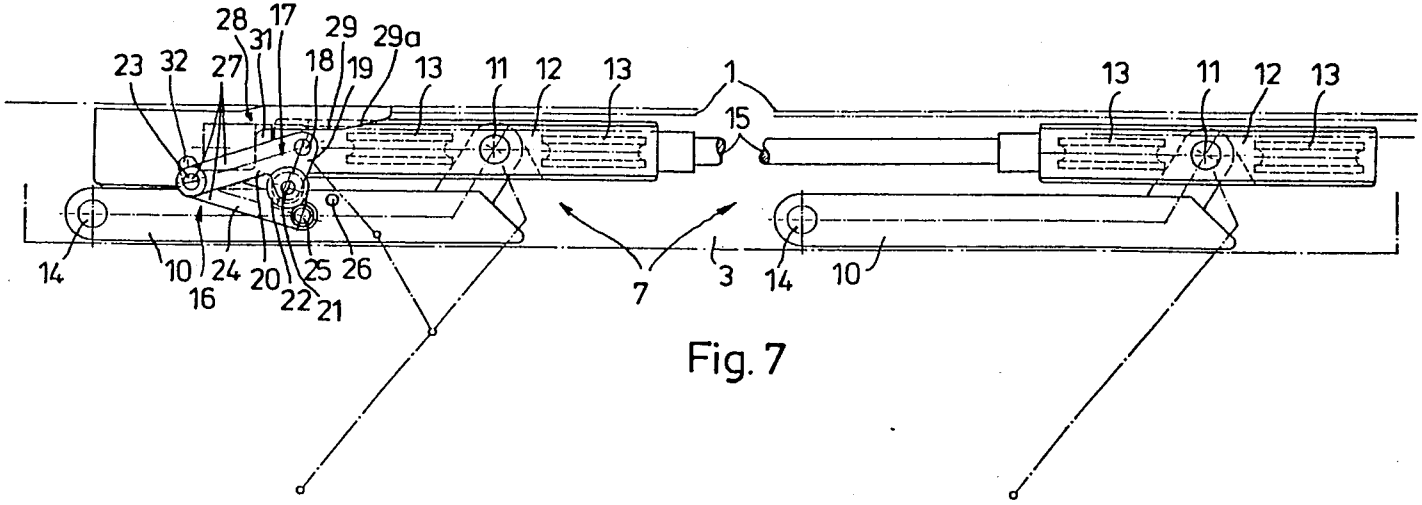
FIG. 7 shows the hardware of the invention in the region VII of FIG. 1 in its operating position corresponding to FIGS. 2 and 4.
Figure 8:
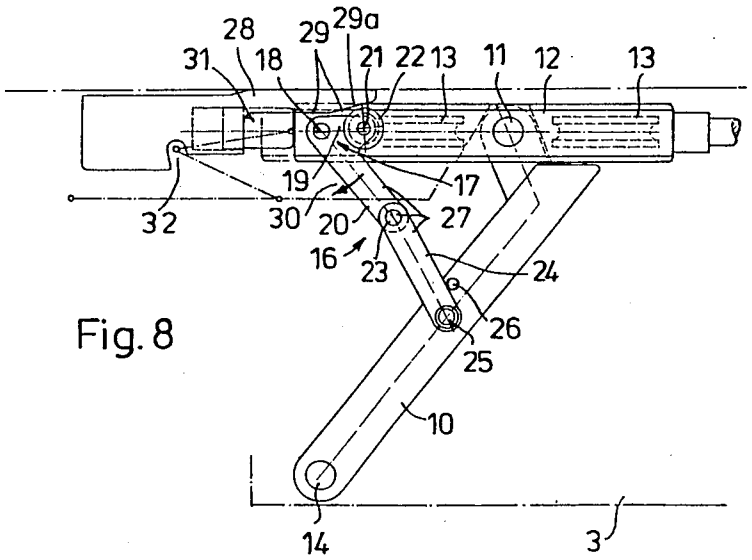
FIG. 8 shows a portion of the hardware in its operating position corresponding to FIG. 6, FIGS. 9 and 10 show front and side elevations of a door in the closed position of the closure.
Figure 9:
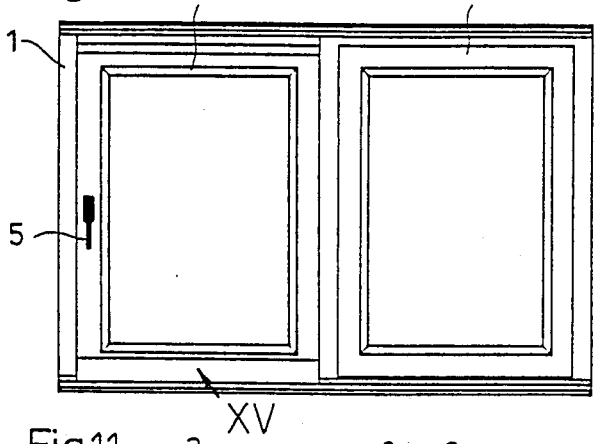
Figure 10:
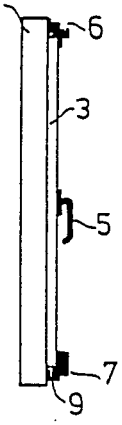
Figure 11:
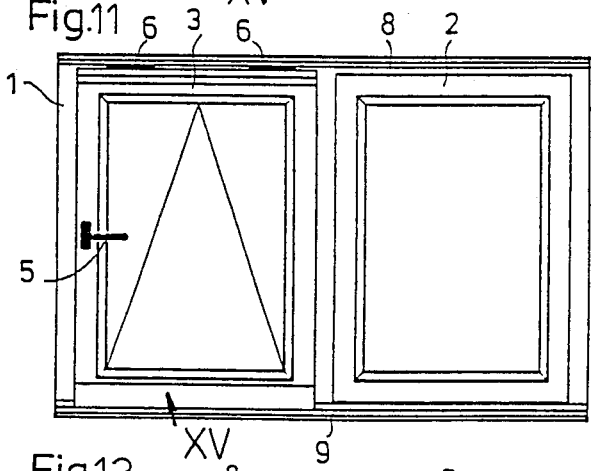
FIGS. 11 and 12 show front and side elevations of the door with the closure opened in tilt position.
Figure 12:
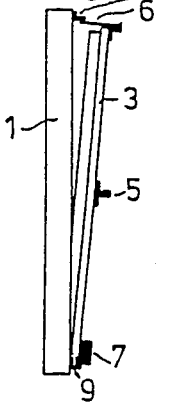
Figure 13:
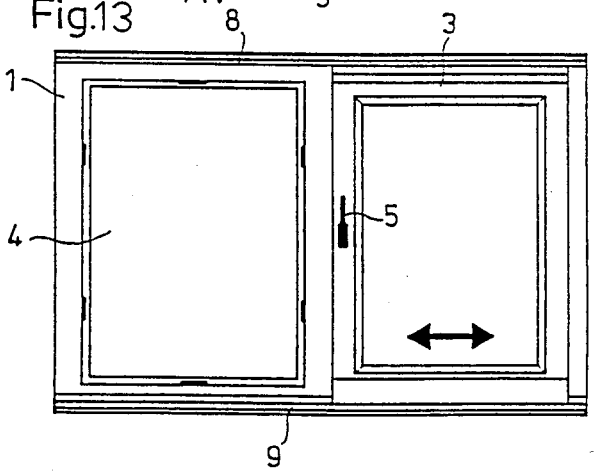
FIGS. 13 and 14 show front and side elevations of the door with the closure horizontally moved into open position.
Figure 14:
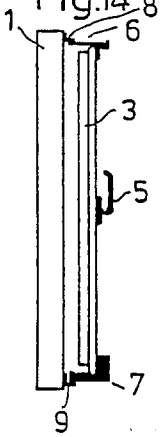

In the present case, what matters mainly is the design and method of operation of the lower disengaging hardware 7 which is shown in FIGS. 7 and 8 in their basic construction and in each case as a top plan view. This disengaging hardware 7 has at least two identical swing arms 10, each one of which can be pivoted relative to a pivot pin 11 on an essentially horizontal plane and that is connected to a traveling carriage 12.

Each of these traveling carriages 12 is provided with two guide rollers 13 that are mounted for free rotation about essentially horizontal axes, by means of which each carriage is supported on the guide rail 9 of the stationary frame 1 for movement parallel to its plane.

The swing arms 10 are connected at their other ends by a pivot pin 14 at the bottom edge of the movable closure 3.

The two traveling carriages 12 of the hardware 7 are solidly connected by a coupling rod 15, so that their bearing axes 11 for the two swing arms 10 are always held in a fixed spacing from one another. Also, the axes 14 of the swing arms 10 are connected at a fixed spacing from each other to the bottom edge of the closure 3 in such a way that the closure 3, the traveling carriage 12 with the coupling rod 15, and the two swing arms 14 combine to form a guide parallelogram. With the help of this guide parallelogram the closure 3 can be shifted transversely of its own plane and also transversely of the plane of the stationary frame 1 between the closed position (shown in FIG. 7) and the parallel-stop position (shown in FIG. 8).

While the disengaging hardware is in the condition shown in FIG. 7, a movement of the closure 3 from the closed position of FIGS. 1 and 2 into the tilt-open position shown in FIGS. 3 and 4 is possible. The closure 3 can also be moved from the parallel-stop position of the hardware 7 shown in FIG. 8 horizontally into the open position shown in FIGS. 5 and 6.

In order that the closure 3 can remain always securely in the parallel-stop position relative to the stationary frame 1 during its horizontal shift relative to the stationary frame 1, it is necessary to block the parallel stop position of the swing arms 10 of the lower hardware 7 relative to the stationary frame 1 or relative to the traveling carriage 12 while moving on its guide rail 9 by means of a special blocking device 16. At the same time, it is necessary that, by release of the blocking device 16, the locking of the parallel-stop position of the swing arms 10 be removed as soon as the closure 3 reaches its slide-close end-position, so that it can be moved from the parallel-stop position of FIG. 8 to the closed position of FIG. 7 in the stationary frame 1.

In the interest of simplicity, a blocking device 16 is provided only between the lower swing arms 10 at the closed side and the traveling carriage 12 which carries it, although it is certainly possible to assign such a blocking device 16 to both swing arms 10 and traveling carriages 12. On account of the interaction of the two swing arms 10 as a guide parallelogram, it is fully sufficient to provide the releasable blocking device 16 only in the region of the swing arm 10 at the closing side of the closure and of the traveling carriage 12 at the same closing side.

The blocking device 16 has a supporting lever 17 which is pivotally mounted on the traveling carriage 12 by means of a pivot 18. This lever swings in a plane parallel to the swivel plane of the swing arm 10. The supporting lever 17 is designed as a bell crank which has a short lever arm 19 and a long lever arm 20. These arms extend relative to the pivot 18 at an acute angle to one another of less than 90°, for example, about 60°.

The short lever arm 19 of the supporting lever 17 carries at its end (as a support lug) a guide roller 22 that is freely rotatable on the pivot 21. The other lever arm 20 is connected through a joint 23 to a connecting rod 24 which in turn operates through a pivot 25 with the swing arm 10. The swing arm 10 is provided with a stop 26 which limits the swinging movement of the connecting rod 24 in one direction, that is, in the direction relative to the bearing pivot 11 of the swing arm 10 toward the traveling carriage 12.

The lever arm 20 of the supporting lever 17 forms with the connecting rod 24 and the pivot 23 a toggle joint 27 which is able to move during the course of the swivel motion of the swing arm 10 from the left-side directed folded position shown in FIG. 7 to the right-side directed extended position shown in FIG. 8. Preferably, the extended position of FIG. 8 has a slight kink position defined by the stop 26, which position is directed opposite to the folded or kink position of FIG. 7.

The folded position of the toggle 27 of FIG. 7 is related to the swivel position of the swing arm 10 which corresponds to the closed position (or the tip opening position) of the closure 3 at the stationary frame 1 in accordance with FIGS. 2 and 4. The extended position of the toggle 27 shown in FIG. 8 is, however, assigned to the parallel-stop position of the swing arm 10, in such a way that this parallel-stop position is locked and the toggle 27 acts as the blocking device 16.

In order to release the blocking device 16 to unlock the parallel-stop position of the swing arm 10, the supporting lever 17 acts with the guide roller 22 (which is pivotally mounted on the short lever arm 19) on a thrust bearing 28 mounted at the stationary frame. This bearing has a stationary cam lead 29 exclusively assigned to the shift-close end-position of the closure 2. This lead cam 29 has a start-up surface 29*a* for the guide roller 22 which rises away from the plane of the stationary frame 1 in direction of the shift-close end-position. As soon as the guide roller 22 strikes this start-up slope 29*a* of the lead cam 29, the supporting lever 17 is automatically swiveled clockwise in the arrow direction 30 around its bearing pivot 18 relative to the traveling carriage 12. The result of this is that the bell crank 17 is moved from its extended position (with the slight kink towards the right) in a displacement motion to the left, so that the blocking device is thereby released.

Now, the traveling carriage 12 with its leading end can strike a start-up buffer 31 that is spring-mounted to oppose the shift-close end-motion in the abutment 28, so that its kinetic energy is absorbed.

When the blocking device 16 is released, the kinetic energy of the closure 3 acts upon the swing arm 10, so that it swivels around the pivot 11 of the traveling carriage 12 toward the stationary frame 1. This moves the toggle 27 in direction of the folded position of FIG. 7. A downwardly-directed extension of the pivot 23 engages a notch claw 32 at the stationary abutment 28, of the closure 3 and of the stationary frame 1. In its position of engagement with the notch claw 32, the extension of the elbow joint at the pivot 23 becomes locked, because the guide roller 22 at the lever arm 19 of the supporting lever 17 is supportingly undercut by an upwardly-directed extension of the pivot 25 for the connection rod 24 at the swing arm 10.

A rearward limiting edge of the notch claw 32 extends somewhat beyond the frontal limiting edge, so that it is assured that the pivot 23 of the toggle 27 enters the notch claw 32 before the start-up buffer 31 has arrived at its inserted final position.

The effect of an opening force applied to the operating handle 5 at the closure 3 is to cause the extension of the pivot 25 to rise from the circumference of the guide roller 22. In this way, the supporting lever 17 then becomes free for a swivel movement.

By means of the interaction of the extension of the pivot 23 with the notch claw 32, the pivot 23 is provided with a displacement motion transversely of the plane of the stationary frame 1. This acts upon the toggle 27 in the sense of an extension from the kink position of FIG. 7 and combines with a swinging of the swing arm 10 from left to right. This results in a moving impulse for the closure 3 in the opposite direction, which impulse is further provided by the start-up buffer 32 acting on the traveling carriage 12. Since the supporting lever 17 with its guide roller 29 has already left the frame-parallel area of the lead cam 29 before the swing arms 10 of the hardware 7 have taken up their final parallel-stop position, the toggle 27 can arrive the extended position of FIG. 8 without interruption, so that the blocking device 16 is again operative.

The lead cam 29, the start-up buffer 31, and the notch claw 32 are provided at the stationary thrust abutment 28 in predetermined reference positions to one another, so that a perfect control of the motion path for the blocking device 16 is ensured both on the closing of the closure 3 from the parallel-stop position, as well as in its opening motion.

FIGS. 9 to 14 of the drawings show a balcony or terrace door which has a stationary closure 2 or a solid door panel in a fixed frame and which is further equipped with a movable closure 3. The construction corresponds generally with that of the FIGS. 1 to 6, so that in this regard the explanations already made above apply here also.

Figure 15:
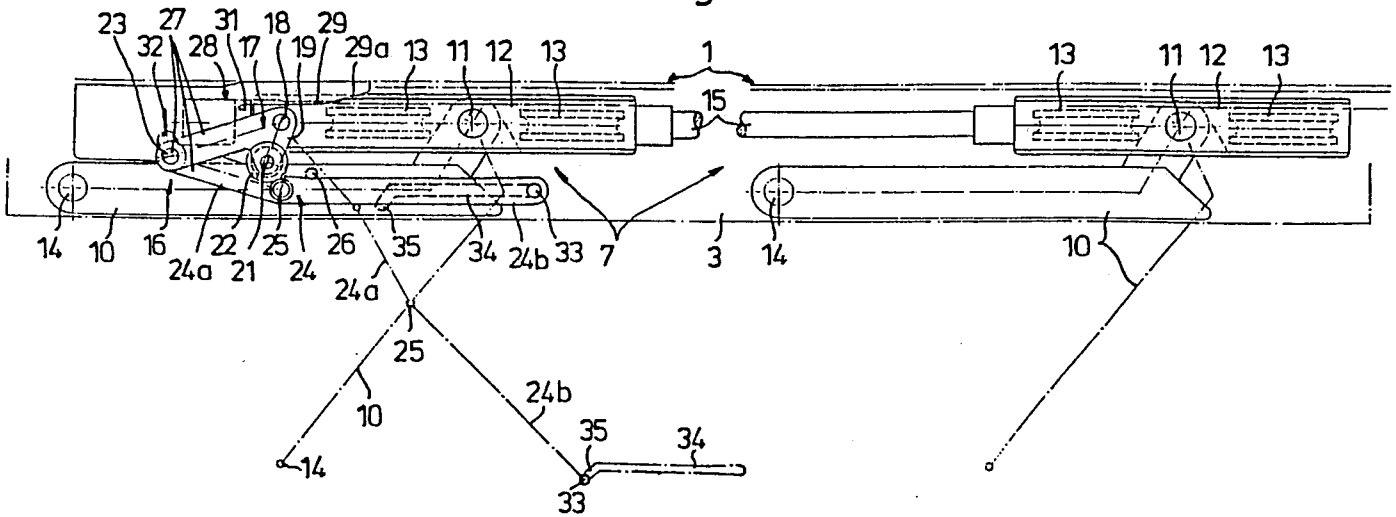
FIG. 15 shows a plan view of the hardware in the region XV and in its operating position corresponding to FIGS. 10 and 12.
Figure 16:
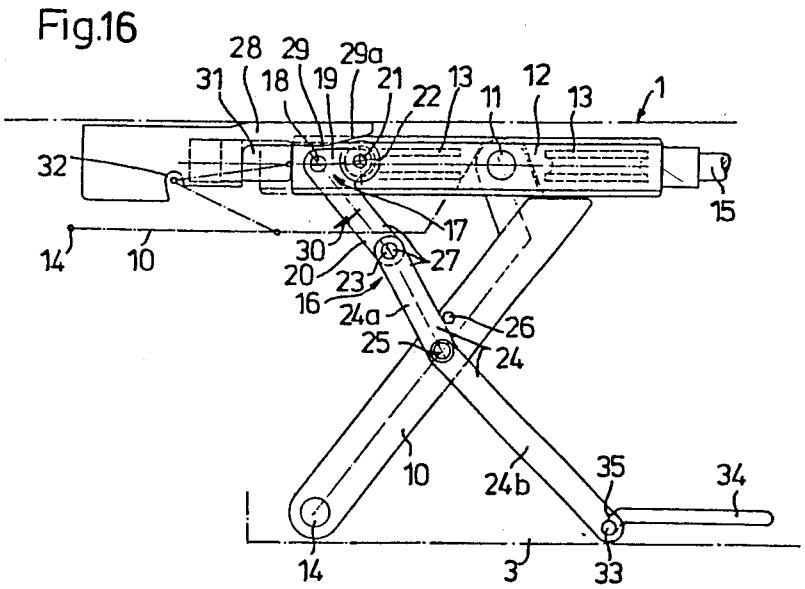
FIG. 16 shows an essential part of the hardware in its operating position corresponding to FIG. 14.

An important development of the hardware 7 on the balcony or terrace door according to FIGS. 9 to 14 consists, as is clear from FIGS. 15 and 16 of the drawing, in the connecting rod 24 being constructed as two-part lever, whose lever arm 24*a* is part of the toggle 27, while its other lever arm 24*b* carries a pinion 33 at the end that is away from the pivot 25. This pinion 33 engages a guide slot 34 provided at the closure 3. This guide slot 34 extends approximately parallel to the plane of the closure 3 and has a length sufficient for the pinion 33 to shift between the position shown in FIG. 15 and the position shown in FIG. 16. This occurs when the closure 3 is moved relative to the stationary frame 1 between the closed position (FIG. 15) and the parallel-stop position (FIG. 16).

At the end which is associated with the parallel-stop position of the closure 3, the guide slot 34 is provided with a notch 35 for the pinion 33 of the lever arm 24*b*. This notch 35 extends at an angle to the guide slot 34. The angle of inclination is at least approximately tangential to a curve whose center coincides with the pivot 25 of the connecting rod 24 at the swing arm 10 while the swing arm 10 is swinging relative to the closure 3 into the parallel-stop position of FIG. 16.

An optimal supporting effect of the lever arm 24*b* of the connecting rod 24 between the closure 3 and the swing arm 10 results when the end of the arm 24*b* is arranged at the closure 3 facing away from the stationary frame 1.

The pinion 33 on the lever arm 24*b* of the connecting rod 24 is swiveled back from the notch 35 into the region of the guide slot 34 when the closure 3 reaches its shift-close end-motion, when the guide roller 22 of the supporting lever 17 impinges on the stationary lead cam 29, and when the toggle 27 is shifted from its extended position corresponding to FIG. 16 in the direction of the folded position corresponding to FIG. 15.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Hardware for a movable closure 3 of a window or door, which closure can be locked in a spaced, parallel position and in this position is horizontally shiftable, which closure has lower swing arms 10 and upper swing arms, wherein the swing arms 10 are in each case pivotally connected to the closure, on the one hand, and pivotally connected to a traveling carriage 12 with a releasable locking device 16 for each swing arm 10 when the closure is located in parallel-stop position, which locking device 16 consists of a bell crank 17 mounted in the vicinity of the traveling carriage 12 and the swing arm 10, which locking device can be moved in or out of working connection by means of a control lug 22 engaging an abutment 28 mounted on a stationary frame 1 by the closing slide movement of the closure 3, characterized by the fact that, the bell crank 17 has two arms and is pivotally mounted on the traveling carriage 12 which carries the control lug 22 at the end of the arm 19 directed toward the stationary frame 1, that the arm 20 directed towards the swing arm 10 is pivotally connected 23 to a connecting rod 24 which is pivoted to the swing arm 10, that the connecting rod 24 and the arm 20 of the bell crank 17 connected with it form a toggle joint 27 which can be automatically reversed by means of the control lug 22 on the bell crank 17 and the frame abutment 28 during the closing slide movement of the closure 3 from an extended position locking the parallel-stop position of the swing arm 10 between the traveling carriage 12 and the swing arm 10 into a folded position which releases the closure, and that the bell crank arm 19 carrying the control lug 22 in the extended position of the toggle joint 27 is provided relative to the closing slide movement of the closure 3 of the support pivot 18 of the bell crank 17 at the traveling carriage 12 in an over-center manner.

2. Hardware as recited in claim 1, characterized by the fact that the two-armed supporting lever 17 is a bell crank 19 on which the two lever arms extend at an acute angle towards one another, whereby the arm 20 in the extended position of the toggle joint 27 also lags relative to the closing slide direction of the closure 3 of the pivot 18 of the supporting lever 17 on the traveling carriage 12.

3. Hardware as recited in claim 2, characterized by the fact that the extended position of the toggle joint 27 locking the parallel-stop position of the swing arms 10 corresponds to a slight bending position defined by a limiting stop which is oriented opposite to the bending position releasing the parallel-stop position of the swing arms 10.

4. Hardware as recited in claim 3, characterized by the fact that the control lug 22 of the supporting lever 17 consists of a guide roller, while the thrust abutment 28 is formed as a stationary lead cam 29 associated with the closing slide movement of the closure 3.

5. Hardware as recited in claim 4, characterized by the fact that the pivot 23 of the toggle joint 27 when in its closed position releasing the parallel-stop position of the swing arms 10 is interlockable with an index claw 32 at the frame abutment 28.

6. Hardware as recited in claim 5, characterized by the fact that, to the index claw 32 is assigned at the abutment 28 a start-up buffer 31 for the traveling carriage 12 which is spring-mounted opposite to the direction of the closing slide movement.

7. Hardware as recited in claim 6, characterized by the fact that the traveling carriage 12 makes support contact with the start-up buffer 31 when the closed position of the toggle joint 27 has already released the parallel-stop position of the swing arms 10.

8. Hardware as recited in claim 7, characterized by the fact that in the closed position of the toggle joint 27, corresponding to the closed position of the closure 3 at the stationary frame 1, the control lug 22 of the supporting lever 17 is supportingly undercut at the swing arm 10 by the pivot 25 of the connecting rod 24.

9. Hardware for a closure 3 of a window or door, which is lockable in a parallel-stop position and in this position is horizontally shiftable, which closure has lower swing arms 10 and upper swing arms, at least the one of the lower swing arms 10 being pivotally connected on the one hand to a lower transverse closure bar and in each case is pivotally connected to a traveling carriage 12 with a releasable locking device 16 for at least the one lower swing arm 10 when located in the parallel-stop position, the locking device consisting of a supporting lever 17 engaging on the one hand in the region of the traveling carriage 12 and which on the other hand can be brought into or out of working connection through a control lug 22 with an abutment 28 located on the stationary frame 1 during the slide-close movement of the closure 3, characterized by the fact that, the supporting lever 17 is a bell crank 19 exclusively mounted by a pivot 18 on the traveling carriage 12, a control lug 22 is carried at the end of the bell crank 19 facing towards the stationary frame 1, while the arm 20, which faces toward the swing arm 10 is exclusively articulated by a pivot 23 to a connecting rod 24, which also is connected by a pivot 25 to the swing arm 10, that furthermore the connecting rod 24 and the pivoted lever arm 20 of the supporting lever 17 form with one another a toggle joint 27, which is reversible by the control lug 22 of the supporting lever 17 and the frame abutment 28 during the slide-closing motion of the closure 3, this reversal operating automatically at least from an extended position locking the parallel-stop position of the swing arm 10 between the traveling carriage 12 and the swing arm 10 to a closed position which releases it, that the bell crank 19 of the supporting lever 17 which carries the control lug 22 in the extended position of the toggle joint 27 is provided relative to the supporting lever 17 at the traveling carriage 12 in a trailing manner, and that the connecting rod 24 is likewise designed as a two-link lever (**24*a*, 24*b*), and that its lever 24*b* projecting beyond the pivot 25 at the swing arm 10 operates to pivot or slide through a pin 33 in a guide slot 34 located on the closure 3, which slot is provided at the end that is associated with the parallel-stop position of the closure 3 with a notch 35 for the pinion 33**.

10. Hardware as recited in claim 9, characterized by the fact that, the notch 35 extends at an angle to the guide slot 34 and that its angle of inclination is approximately tangential to a curve the center of which is in alignment with the pivot 25 of the connecting rod 24 on the swing arm 10 located in the parallel-stop position relative to the closure 3.

11. Hardware as recited in claim 10, characterized by the fact that the notch 35 is provided with its terminal end extending away from the stationary frame 1 on the closure 3.

* * * * *